US005230261A

United States Patent [19]

Akazawa et al.

[11] Patent Number: 5,230,261

[45] Date of Patent: Jul. 27, 1993

[54] ELECTRIC POWER TOOL

[75] Inventors: Shumi Akazawa; Nobuto Kai, both of Fuchu, Japan

[73] Assignee: Ryobi Limited, Tokyo, Japan

[21] Appl. No.: 842,947

[22] Filed: Feb. 27, 1992

[30] Foreign Application Priority Data

Feb. 28, 1991 [JP] Japan ..... 3-10068[U]

[51] Int. Cl.[5] ..... B25B 13/00

[52] U.S. Cl. ..... 81/54; 81/177.4; 81/439

[58] Field of Search ..... 81/52, 54, 177.1, 177.4, 81/439, 490; 173/29, 49, 163; 408/20, 21, 124

[56] References Cited

U.S. PATENT DOCUMENTS 4,269,311 5/1981 Rich ..... 81/177.4 X
4,759,240 7/1988 Lin ..... 81/54 X
4,962,681 10/1990 Yang ..... 81/54

*Primary Examiner*—James G. Smith
*Attorney, Agent, or Firm*—Brooks & Kushman

[57] ABSTRACT

A power tool comprises a tool body having a grip portion and composed of a pair of base and cover housing halves, a chuck which is mounted onto the front end of the tool body and onto which a bit for working a workpiece is detachably mounted, a bit accommodating portion having an opening formed on a surface portion of the tool body and being adapted to accommodate a spare bit, and a bit holding member, having an elastic property, disposed in the bit accommodating portion for elastically holding the spare bit accommodated in the bit accommodating portion. The bit accommodating portion is formed as a recessed portion extending along a longitudinal direction of the tool body and having a length suitable for the accommodation of the spare bit. The bit holding member is disposed in the bit accommodating portion at substantially a longitudinally central portion thereof so as to extend along the longitudinal direction of the bit accommodating means to thereby form the bit accommodating portion as a pair of bit accommodating recesses to both sides of the bit holding member for accommodating two spare bits therein. The bit accommodating portion is provided with a groove at the joint portion of base and cover housings of the tool body.

11 Claims, 7 Drawing Sheets

ELECTRIC POWER TOOL

BACKGROUND OF THE INVENTION

This invention relates to a power tool and, more particularly, to an electric power driven tool provided with a bit accommodation unit for accommodating a spare bit for performing a desired task.

In known electric power tools of a pistol type structure having a tool body, a chuck is mounted onto its forward front, and a bit as a rotary tool blade is mounted in the chuck, which is driven by an electric motor. The motor is driven by operating a trigger switch incorporated in the tool body to thereby rotate and drive the bit mounted in the chuck to perform a desired task. Some of these known electric power tools are equipped with bit accommodation units each for accommodating another bit to be exchanged with one mounted in onto the chuck.

One example of the prior art electric power tools of the structure described above is disclosed in Japanese Utility Model Laid open (KOKAI) Publication No. 50 83672, in which an inner space is defined in the tool body at a side portion thereof. The inner space has a cover opened or closed by handling a gripping portion additionally provided for the tool body. This space is utilized for accommodating a bit to be exchanged with one used, and the bit is taken out from the space through the front end portion of the gripping portion by opening the cover.

The prior art further provides a bit accommodation unit, such as disclosed in Japanese Utility Model Laid open (KOKAI) Publication No. 53 153584, in which a bit accommodation case is disposed on an upper portion of a main handle provided for a tool body and a case cover is provided on the upper portion of the tool body to be opened or closed. A bit to be exchanged is accommodated in this case and taken out by opening the cover.

The prior art further provides a bit accommodation unit, such as disclosed in Japanese Patent Laid open (KOKAI) Publication No. 56 56388, in which a bit accommodation recess is formed inside a grip portion of the tool body and a bit accommodation case is disposed detachably in the recess. The bit case is mounted in the recess or taken out therefrom with the bit being accommodated in the case.

However, in the first type structure of the prior art, since the gripping portion is additionally provided on the tool body, the bit cannot be accommodated in the tool body which is not provided with such an additional gripping portion. In the first and second type structures of the prior art, it is required to open the cover to transfer the bit in or out of the tool body and close the cover after the transfer, thus being inconvenient and making complicated the structure of the tool body. Furthermore, there is a fear of damaging or losing the cover during the life of the power tool. Also, if the cover is not completely closed, the bit may fall out.

Still furthermore, in the type of the third structure of the prior art, since the bit accommodation recess is formed in the gripping portion of the tool body, spaces for accommodating or incorporating other elements such as a motor switch are limited, thus being not practical. The transfer of the bit in or out of the bit accommodation unit would be troublesome.

SUMMARY OF THE INVENTION

An object of this invention is to substantially eliminate defects or drawbacks encountered in the prior art and to provide a power tool provided with a bit accommodating means capable of transferring spare bits into or out of the bit accommodating means without providing any cover or case for the accommodation of the bits.

This and other objects can be achieved according to this invention by providing a power tool comprising a tool body including a base housing into which parts or elements for the power tool are incorporated and a cover housing having a shape substantially symmetric with the base housing, the base and cover housings being mated and joined together to thereby form the tool body, a chuck which is mounted onto one end of the tool body and onto which a bit for working a workpiece is detachably mounted, a bit accommodating means having an opening formed on a surface portion of the tool body and being adapted to accommodate at least one spare bit, and a bit holding means disposed in the bit accommodating means for resiliently holding the spare bit accommodated in the bit accommodating means.

In preferred embodiments, the bit accommodating means is formed as a recessed portion extending along a longitudinal direction of the tool body and having a length suitable for the accommodation of the spare bit. The bit holding means is disposed in the bit accommodating means at substantially a longitudinally central portion thereof so as to extend along the longitudinal direction of the bit accommodating means to thereby form the bit accommodating means as a pair of bit accommodating portions on both sides of the bit holding means for accommodating two spare bits therein, and wherein the bit accommodating means is provided with a groove at the joint portion of the base and cover housings of the tool body, the groove extending along the longitudinal direction of the bit accommodating means, the bit holding means being disposed in the groove. The bit holding means comprises a bit securing member extending along the longitudinal direction of the bit accommodating means and a bit gripping member attached to the bit securing member, the bit gripping member being formed of a material having resiliency for resiliently holding the spare bit. The bit securing member is composed of a plate-like body extending along the longitudinal direction of the bit accommodating means and having a central portion in which is formed an opening through which the bit gripping member is screw-engaged, a pair of flanged pieces integrally formed on the plate like body at front and rear portions of one edge portion thereof so as to project laterally, and a pair of ribs integrally formed on another edge portion of the plate like body with cutouts at facing ends of the ribs, the ribs having laterally projecting portions, and the flanged pieces are engaged with a pair of engaging holes formed at an upper central portion of the bit accommodating means and disposed side by side in the longitudinal direction of the bit accommodating means at the upper central portion, the engaging holes being opened in the groove. The bit gripping member is provided with a flat body and a pair of gripping pieces extending downwardly from the flat body so as to be disposed in the cutouts of the ribs when the bit gripping member is fastened to the bit securing member. The bit gripping member is further provided with bit holding pieces integrally formed on lower end portions of the gripping pieces, respectively, the bit holding pieces being outwardly arcuately bent, wherein the bits are pushed and then held into the bit accommodating portions against a resilient force of the bit gripping pieces and bit holding pieces.

The bit accommodating means is formed on a lower surface portion of the tool body. A plurality of bit accommodating means are formed on a plurality of portions of the tool body.

The power tool is of a pistol type structure and the tool body has a grip portion. The power tool further comprises a trigger switch mounted on the grip portion of the tool body for driving and controlling a rotation of the chuck, a lever member disposed near the trigger switch for changing the rotating direction of the chuck, and a slide lever member disposed to the tool body for changing rotation speed of the chuck.

In the power tool having the structures described above, a spare bit or bits are accommodated into the elongated bit accommodating means by pushing the bit thereinto against the resilient force of the bit holding means and are also taken therefrom by forcibly pulling the spare bit against the resilient force. The spare bit accommodated in the bit accommodating means is firmly held therein by the resiliency of the bit holding means disposed in the bit accommodating means, whereby any specific bit cover member or case member can be eliminated, thus allowing the power tool to be more compact and facilitating bit transfer to and from the bit accommodation.

BRIEF DESCRIPTION OF THE DRAWINGS

For a better understanding of this invention and to show how the same is carried out, reference is first made, by way of the preferred embodiment, to the accompanying drawings, in which.

DESCRIPTION OF THE PREFERRED EMBODIMENT

Figure 1:
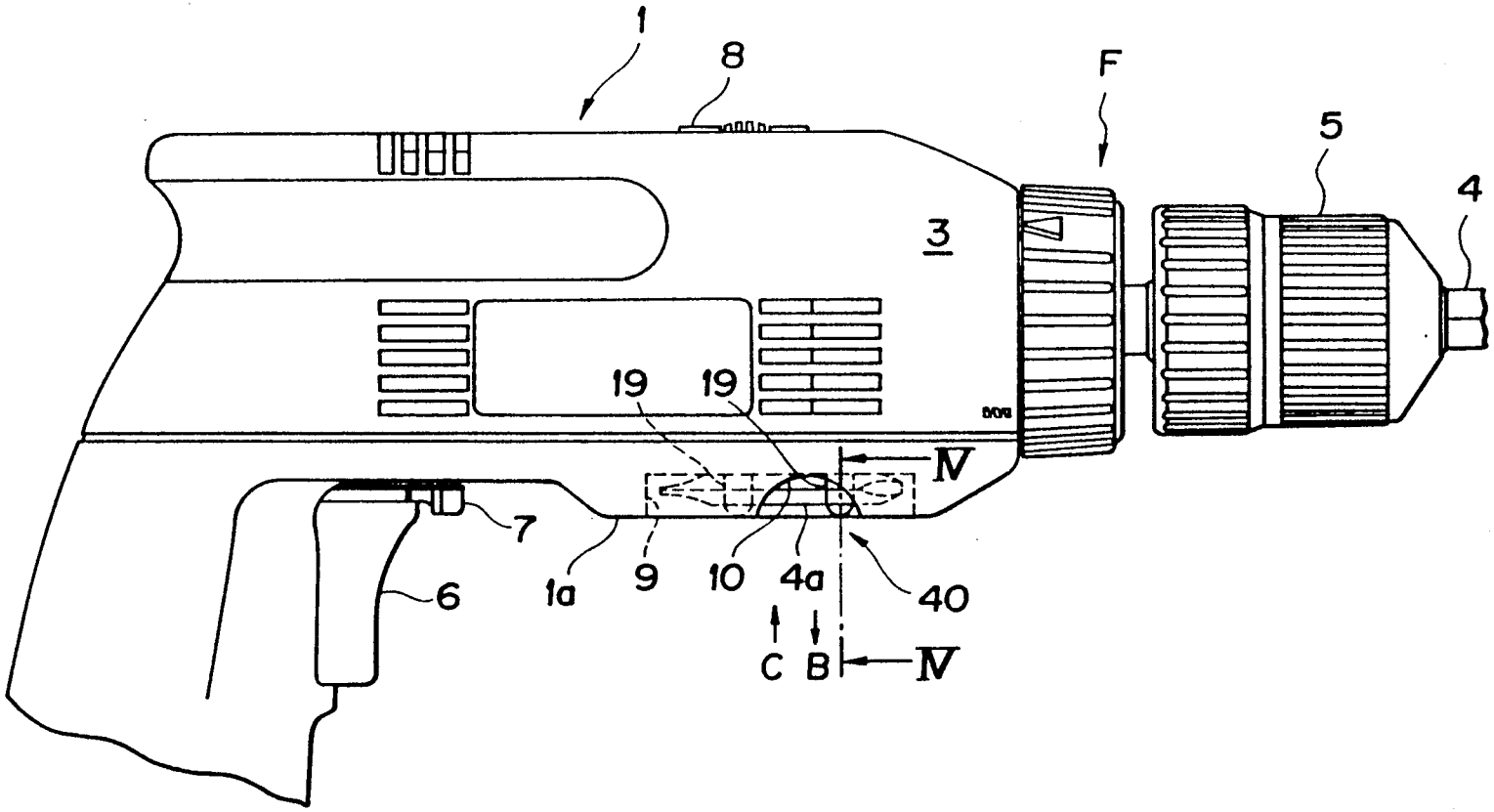
FIG. 1 is a side view showing the outer appearance of a power tool according to this invention, partially broken away.

FIGS. 1 to 8 represent one preferred embodiment according to this invention, and first referring to FIGS. 1 to 5, an electric power tool of this invention is of a pistol type structure and comprises a tool body 1 including a grip portion, which is formed by joining two half housings 2 and 3. One of them is formed as a base housing 2 into which various parts or elements are incorporated and the other of them is formed as a cover housing 3 substantially symmetric with the base housing 2. Hereinafter, a portion on the side of a chuck of the tool body 1 is referred to as a front portion and, on the contrary, a portion on the side of the grip portion is referred to as a rear portion, as shown in FIGS. 1, 2, 3A and 3B, for the sake of convenience. Accordingly, the chuck 5 onto which a bit 4 as a rotary tool element for working a workpiece is detachably mounted is mounted onto the front portion F of the tool body 1. The chuck 5 is rotated in normal and reverse directions by the operation of an electric drive motor incorporated in the tool body 1. A trigger switch 6 is attached to the grip portion of the tool body 1 for switching the motor operation to an ON or OFF state, and a rotation change lever 7 is incorporated above the trigger switch 6 for changing the rotating direction of the drive motor. A slide lever 8 is also provided on the upper surface portion of the tool body 1 for changing the rotating speed of the drive motor.

According to the present embodiment, the tool body 1 is provided with a recessed portion 9 with an opening formed on the surface of the tool body 1 for accommodating a spare bit 4*a*. The bit 4*a* is held by a bit holding means 40, which has a resilient property, is disposed in the recessed portion 9 and is adapted to hold the bit 4*a* by virtue of its resilience. As shown in FIGS. 2 to 5, for example, the bit accommodating recessed portion 9 is formed on the front lower portion of the tool body 1 at the joint portion of the base and cover housing halves 2 and 3 so as to straddle the sames. A laterally cylindrical bit take out portion 10 having a circular cross section is formed in the tool body 1 as a cutout portion. The bit accommodating recessed portion 9 has an elongated shape along the longitudinal direction of the tool body 1 so that the bit 4*a*, usually having a rod-like shape, can be effectively accommodated in the recessed portion 9.

Figure 3A:
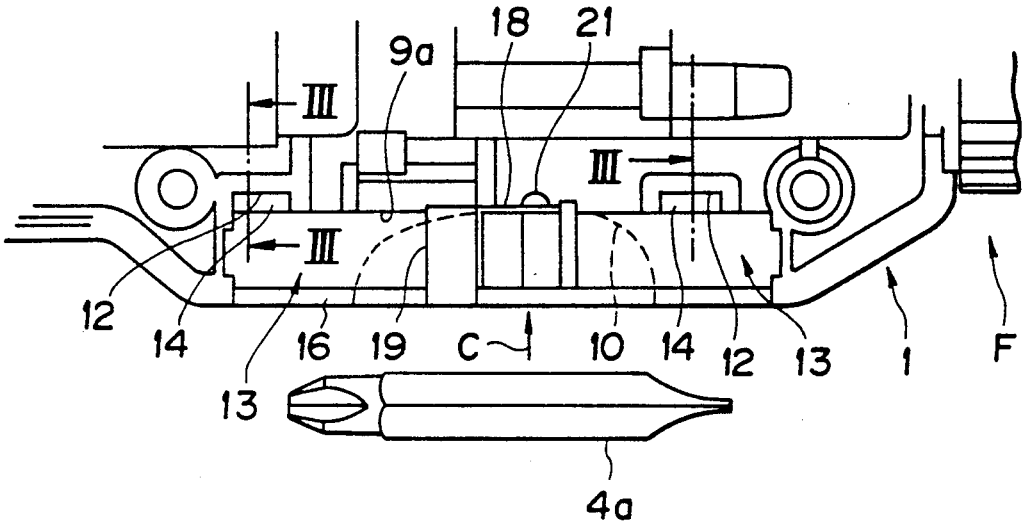
FIG. 3A is a view similar to that of FIG. 2 in a state wherein the bit is positioned to be accommodated.
Figure 3B:
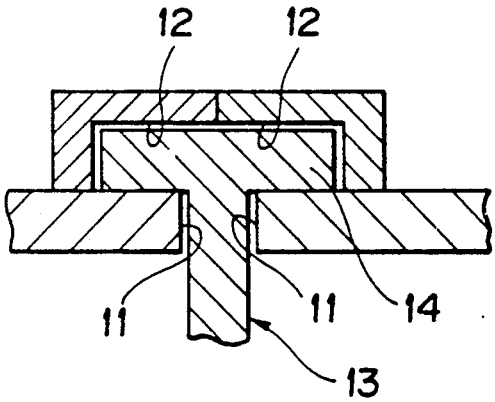
FIG. 3B is a sectional view taken along the line III III in FIG. 3A.
Figure 4:
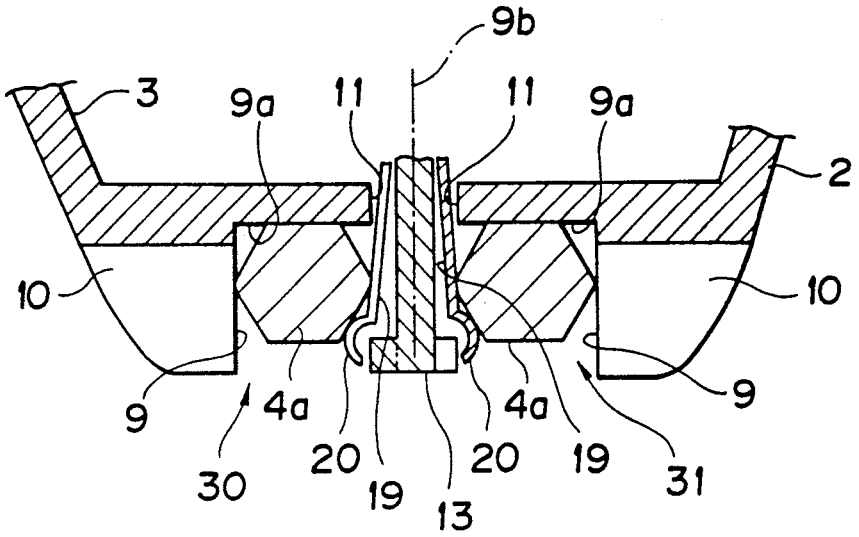
FIG. 4 is a sectional view, in an enlarged scale, taken along the line IV IV of FIG. 1.
Figure 5:
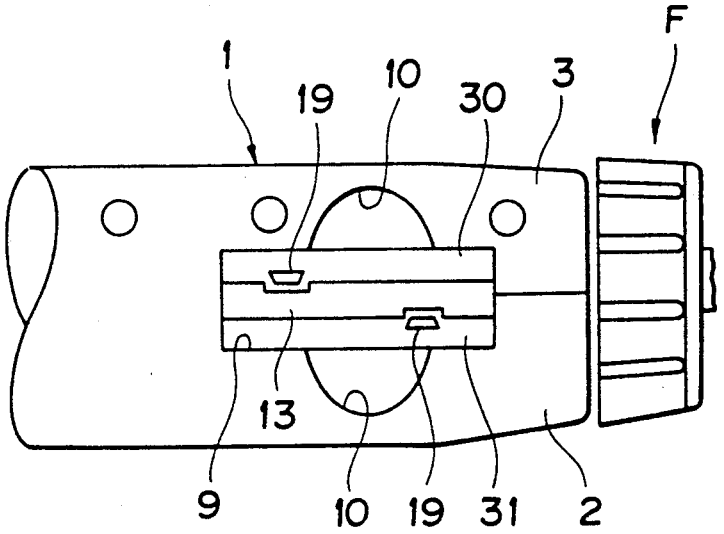
FIG. 5 is a view of a front portion, in an enlarged scale, of the power tool of FIG. 1 viewed from the lower side thereof.

Particularly, referring to FIGS. 3B and 4, a groove 11 adapted for a bit securing member 13 is formed at the joint portion of the base housing 2 and the cover housing 3 on the upper surface side 9*a* of the recessed portion 9 so as to extend in the longitudinal direction of the recessed portion 9. A pair of engaging holes 12, 12 opened to the groove 11 are formed side by side in the longitudinal direction at the central portion of the upper surface 9*a* of the recessed portion 9. The bit securing member 13 extending along the longitudinal direction of the bit accommodating recessed portion 9 is disposed in the groove 11 at the longitudinal central portion of the recessed portion 9.

Figure 6:
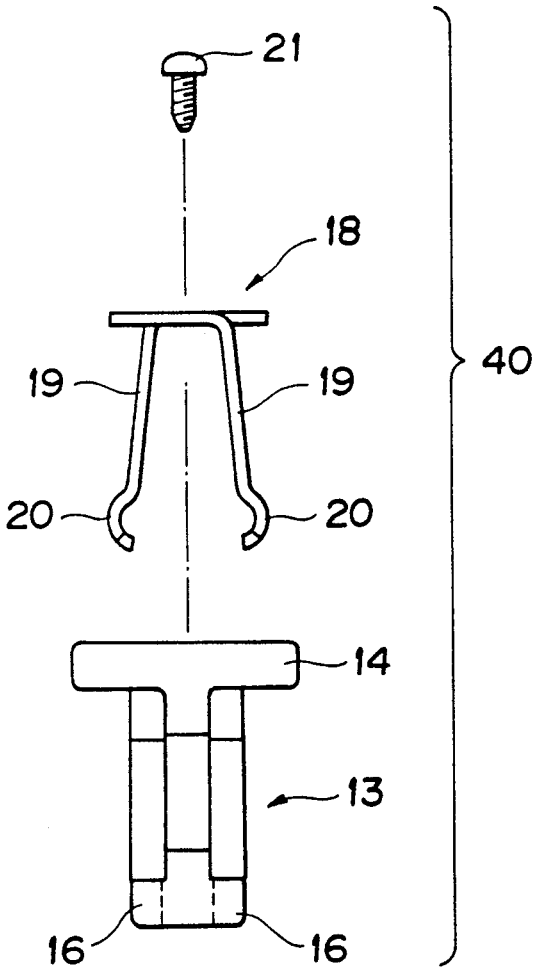
FIG. 6 is a developed view of a bit holding member of the power tool according to this invention.
Figure 7:
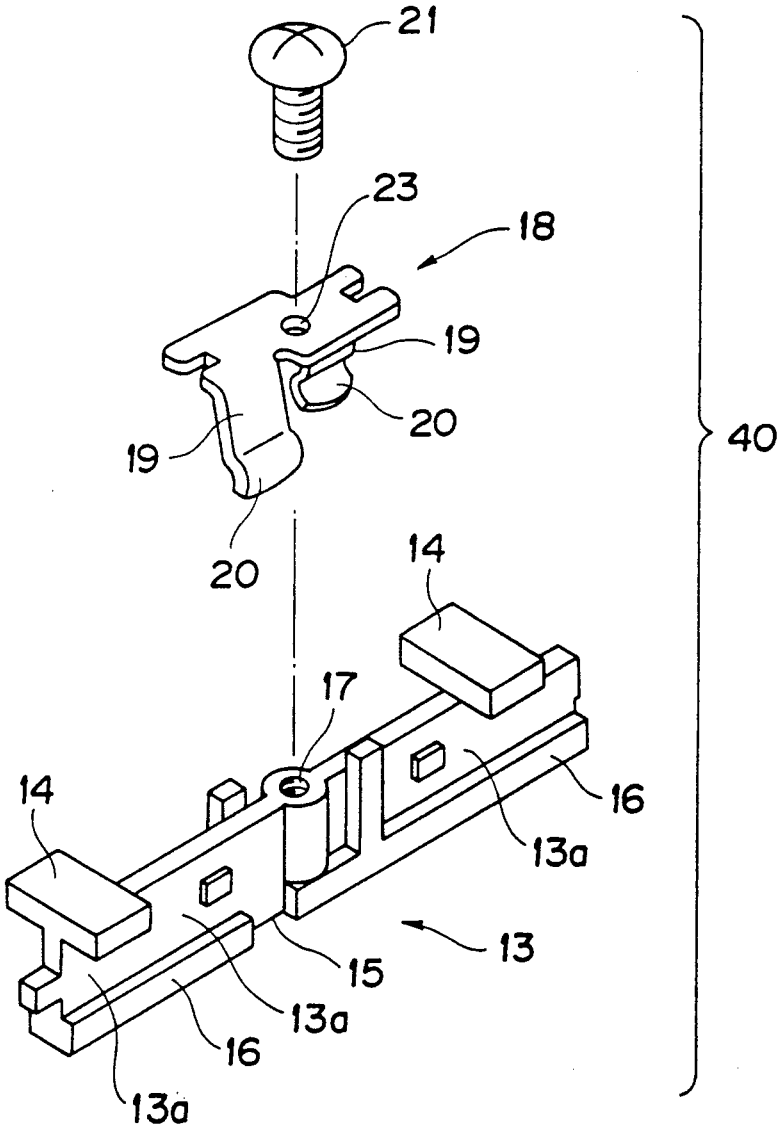
FIG. 7 is a developed perspective view of the bit holding member of FIG. 6.

As shown in FIGS. 6 and 7, the bit securing member 13 has a plate-like body 13*a* having an upper edge portion, as viewed, on which a pair of engaging flanged pieces 14 and 14, each projecting laterally, are integrally formed. The paired flanged pieces 14 and 14 are formed at portions suitable for the engagement with the paired engaging holes 12 and 12, respectively, as shown in FIGS. 3A and 3B, in which the flanged pieces 14 are fitted in the engaging holes 12. The body 13*a* of the bit securing member 13 has a lower edge portion to which are attached ribs 16 and 16 having slightly laterally projecting portions, and cutout portions 15 and 15 are formed between the facing ends of both the ribs 16 and 16. The plate-like body 13 is also provided with a central portion in which an upwardly opened screw hole 17 is formed, and in the illustration of FIG. 7, the central portion is formed as a cylindrical portion.

A bit gripping member 18 made of a springy steel is disposed on the upper surface of the bit securing member 13. As shown in FIGS. 6 and 7, the bit gripping member 18 has a flat portion having a through hole 23 at its central portion and the hole 23 is aligned with the screw hole 17 when the bit gripping member 18 is positioned on the upper surface of the bit securing member 13, and the bit gripping member 18 is fastened to the bit securing member 13 by fastening a screw 21, for example. The bit gripping member 18 also has a pair of gripping pieces 19 and 19 which are integrally formed with the front left side and rear right side of the flat portion so as to downwardly extend toward the cutout portions 15 of the ribs 16, and the lower ends of the gripping pieces 19 and 19 are arcuately bent outwardly as holding portions 20 and 20 as best shown in FIG. 4 in sections. As described above, the bit holding means 40 for elastically holding the bit 4*a* in the bit accommodating recessed portion 9 is comprised of the bit securing member 13 and the bit gripping member 18 secured to the bit securing member 13 by means of the screw 21.

The assembling process of the power tool according to this invention will be described hereunder with reference to FIG. 8.

Figure 2:
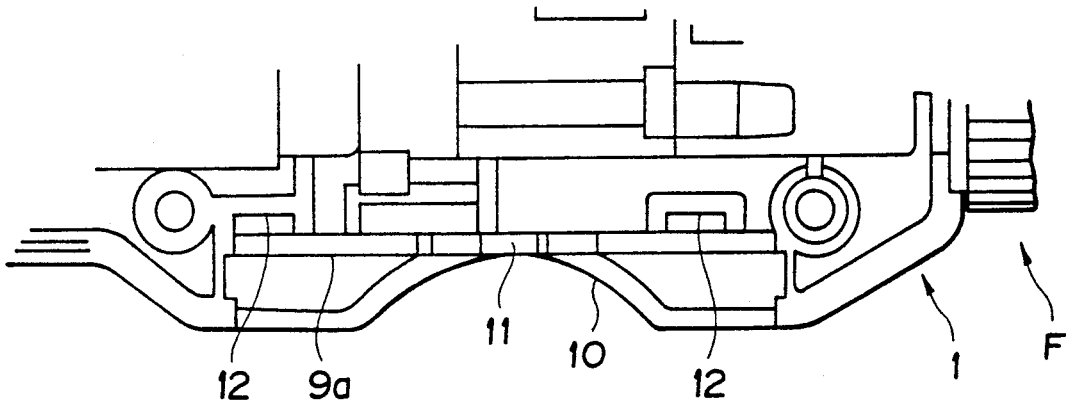
FIG. 2 is an enlarged front view showing a bit accommodating portion of a joint portion of a tool body of the power tool before a spare bit is accommodated.
Figure 8:
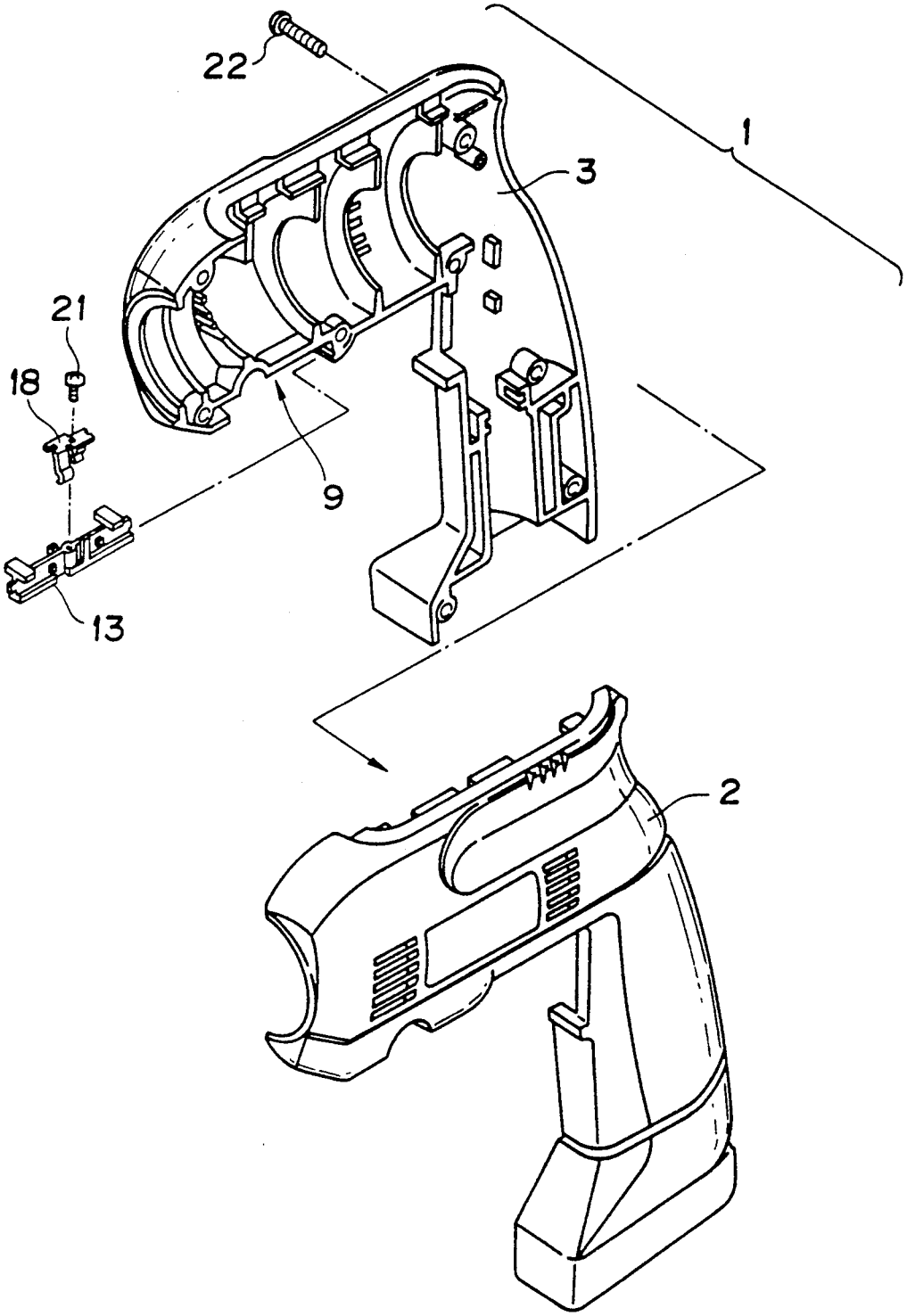
FIG. 8 is a developed perspective view of the tool body of the power tool shown in FIG. 1.

Referring to FIG. 2 and to FIG. 8, which shows a separated view of the base housing 2 and the cover housing 3, the engaging flanged pieces 14 of the bit securing member 13 with the bit gripping member 18 being secured thereto are engaged with the engaging holes 12 respectively formed on the housings 2 and 3. The housings 2 and 3 are mated and joined together by means of a plurality of screws 22, whereby the bit securing member 13 is fastened to the inner central portion of the bit accommodating recessed portion 9 of the tool body 1 as shown in FIGS. 3A and 3B. In this fastened state, as best shown in FIG. 4, the bit accommodating portions 30 and 31 are formed in the recessed portion 9 along the longitudinal direction of the tool body 1 by separating the inner space thereof by the bit securing member 13. Two additional bits 4*a* and 4*a* are then fitted in the accommodating portions 30 and 31, respectively, by pushing them thereinto, and the fitted bits 4*a* and 4*a* can be stably held in the bit accommodating portions 30 and 31 by the resilience of the holding portions 20 and 20 of the gripping pieces 19 and 19 of the bit gripping member 18.

The power tool according to this invention will be operated or handled in the following manner.

A desired bit 4 is first mounted in the chuck 5 of the tool body 1. Then, the operator grips the gripping portion of the tool body 1 and pulls the trigger switch 6 with a finger. Accordingly, the drive motor is driven and the chuck 5 is rotated with the bit 4.

When the bit 4 is to be exchanged with another, the fingers of the operator are inserted into the recessed portion 10 for to grasp the spare bit 4*a* accommodated in the bit accommodating portion 30 or 31 formed in the recessed portion 9. Then, the new bit 4*a* is taken out of the accommodating portion 30 or 31 by pulling, in the direction of arrow B in FIG. 1, the bit 4*a* against the resilient force of the gripping pieces 19 and the holding portions 20 of the bit gripping member 18. In this manner, the new bit 4*a* can be easily taken out of the tool body 1, and exchanged with the bit 4 in the chuck 5. The bit 4 removed from the chuck 5 can be easily accommodated in the accommodating portion 30 or 31 in the recessed portion 9 by pushing the bit 4 thereinto against the resilient force of the gripping pieces 19 and the holding portions 20 of the bit gripping member 18 in the direction of arrow C in FIG. 1.

As described above, according to this invention, the bit can be easily taken out of or accommodated in the predetermined portion formed in the tool body through the opening formed on the lower portion of the tool body against the resilient force of the bit gripping member. According to this structure, a cover member or case member can be eliminated, thus the structure can be compact, eliminating additional work required by these members.

In the described embodiment, the recessed portion for accommodating the bit is formed on the lower portion of the tool body, but such a recessed portion may be formed on an upper portion or side portion of the tool body. Furthermore, the accommodating recessed portions may be separately formed in these portions as occasion demands. The location of a plurality of the bit attaching members 13 side by side may make it possible to form additional bit accommodating portions so as to accommodate a plurality of spare bits.

What is claimed is:

1. A power tool comprising:

a tool body including a base housing into which parts or elements for the power tool are incorporated and a cover housing having a shape substantially symmetric with the base housing, said base and cover housing being mated and joined together through a joint portion to thereby form the tool body;

a chuck which is mounted onto one end of the tool body and onto which a bit for working a workpiece is detachably mounted;

a bit accommodating means having an opening formed on a surface portion of the tool body and being adapted to accommodate at least one spare bit, said bit accommodating means being formed at a joint portion of the base and cover housings to straddle the joint portion; and holding means having a resilient property and being disposed in the bit accommodating means for resiliently holding the spare bit accommodated in the bit accommodating means.

2. A power tool according to claim 1, wherein the bit accommodating means is formed as a recessed portion extending along a longitudinal direction of the tool body and having a length suitable for the accommodation of the spare bit.

3. A power tool according to claim 2, wherein the bit accommodating means is provided with a cutout portion for accommodating in and taking the spare bit from the recessed portion, said cutout portion having a cylindrical shape in a lateral direction of the tool body and having an arcuate shape in section.

4. A power tool according to claim 2, wherein the bit holding means is disposed in the bit accommodating means at substantially a longitudinally central portion thereof so as to extend along the longitudinal direction of the bit accommodating means to thereby form the bit accommodating means as a pair of bit accommodating portions on both sides of the bit holding means for accommodating two bits therein, and wherein the bit accommodating means is provided with a groove at the joint portion of the base and cover housings of the tool body, said groove extending along the longitudinal direction of the bit accommodating means, said bit holding means being disposed in the groove.

5. A power tool according to claim 4, wherein the bit holding means comprises a bit securing member extending along the longitudinal direction of the bit accommodating means and a bit gripping member attached to the bit securing member, said bit gripping member being formed of a resilient material for resiliently holding the spare bit.

6. A power tool according to claim 5, wherein the bit gripping member is fastened to the bit securing member by means of a screw.

7. A power tool according to claim 6, wherein the bit securing member is composed of a plate like body extending along the longitudinal direction of the bit accommodating means and having a central portion in which is formed an opening through which the bit gripping member is screw engaged, a pair of flanged pieces integrally formed on the plate like body at front and rear portions of one edge portion thereof so as to laterally project, and a pair of ribs integrally formed on another edge portion of the plate like body with cutouts at ends of the ribs, said ribs having laterally projecting portions, and wherein the flanged pieces are engaged with a pair of engaging holes formed at an upper central portion of the bit accommodating means and disposed side by side in the longitudinal direction of the bit accommodating means at the upper central portion, said engaging holes being opened in the groove between the base and cover housings.

8. A power tool according to claim 7, wherein the bit gripping member is provided with a flat body and a pair of gripping pieces extending downwardly from the flat body so as to be disposed in the cutouts of the ribs when the bit gripping member is fastened to the bit securing member.

9. A power tool according to claim 8, wherein the bit gripping member is further provided with bit holding pieces integrally formed on lower end portions of the gripping pieces, respectively, said bit holding pieces being outwardly arcuately bent, wherein the spare bits are pushed and then held into the bit accommodating portions against a resilient force of the bit gripping pieces and bit holding pieces.

10. A power tool according to claim 5, wherein a plurality of bit securing members are disposed side by side in the bit accommodating portion so as to accommodate at least two spare bit.

11. A power tool according to claim 1, wherein the bit accommodating means is formed on a lower surface portion of the tool body.

* * * * *

UNITED STATES PATENT AND TRADEMARK OFFICE

CERTIFICATE OF CORRECTION

PATENT NO. : 5,230,261

DATED : July 27, 1993

INVENTOR(S) : Shumi Akazawa and Nobuto Kai

It is certified that error appears in the above-indentified patent and that said Letters Patent is hereby corrected as shown below:

Column 1, Line 12, after "forward" delete "front" and insert --portion--;

Column 1, Line 20, delete --onto--;

Column 7, Line 18, Claim 7, after "at" insert --facing--;

Column 8, Line 20, Claim 10, after "spare" replace "bit' with --bits--.

Signed and Sealed this

Eighth Day of August, 1995

Bruce Lehman

*Attest:*

BRUCE LEHMAN

*Attesting Officer*

*Commissioner of Patents and Trademarks*